US006698029B2

(12) United States Patent
Tadros

(10) Patent No.: US 6,698,029 B2
(45) Date of Patent: Mar. 2, 2004

(54) PANTS CONVERTIBLE INTO HAMMOCK

(76) Inventor: Michael Tadros, 1155 S. Barrington Ave., Los Angeles, CA (US) 90049

( * ) Notice: Subject to any disclaimer, the term of this patent is extended or adjusted under 35 U.S.C. 154(b) by 0 days.

(21) Appl. No.: 10/393,748

(22) Filed: Mar. 20, 2003

(65) Prior Publication Data

US 2003/0196243 A1 Oct. 23, 2003

Related U.S. Application Data

(60) Provisional application No. 60/367,190, filed on Mar. 21, 2002.

(51) Int. Cl.[7] ..... A41D 1/06
(52) U.S. Cl. ..... 2/227; 5/120
(58) Field of Search ..... 2/69, 71, 72, 79, 2/227, 232, 115, 88, 89, 85, 86; 5/120–130; 297/118; 383/4

(56) References Cited

U.S. PATENT DOCUMENTS 650,074 A * 5/1900 Conley ..... 2/89
672,730 A * 4/1901 Conley ..... 2/79
748,288 A * 12/1903 Klein ..... 224/156
1,138,229 A * 5/1915 Knoblauch ..... 2/89
1,515,263 A * 11/1924 Matsusaki ..... 5/120
3,837,019 A * 9/1974 Hoff ..... 5/93.1
4,484,362 A * 11/1984 Asher ..... 2/69
4,574,397 A 3/1986 Dennard
4,700,409 A 10/1987 De Lott
5,560,056 A * 10/1996 Tai ..... 5/120
5,774,892 A 7/1998 Tisdale et al.
5,864,888 A 2/1999 Archer
6,014,772 A 1/2000 Connelly
6,061,831 A 5/2000 Rudolph
6,108,815 A 8/2000 Majerfeld
6,260,209 B1 7/2001 St. Ange
6,330,720 B1 12/2001 Steelman
6,336,226 B1 1/2002 Garcia

* cited by examiner

*Primary Examiner*—Tejash Patel
(74) *Attorney, Agent, or Firm*—Beeson Skinner Beverly, LLP; Brian Beverly

(57) ABSTRACT

Pants convertible into a hammock comprise a pair of pant legs separable by unfastening front and back fasteners extending from the waist to crotch of the pant legs, each pant leg openable to a flat formation by unfastening an inseam fastener, the opened pant legs convertible into a hammock configuration by abutting and fastening together bottom edges of the pant legs, wherein the hammock pants may be suspended from an adjacent structure by inserting a pair of rigid rods into sleeves provided at the waist portion of the pant legs in the hammock configuration, and by unfolding a plurality of straps attached to the inside surfaces of the pant legs and extending the straps from the ends of the rigid rods to anchor points on the adjacent structure.

24 Claims, 13 Drawing Sheets

PANTS CONVERTIBLE INTO HAMMOCK

This application claims the benefit of U.S. provisional application No. 60/367,190, filed Mar. 21, 2002.

BACKGROUND OF THE INVENTION

This invention relates to multiple use clothing and in particular to a pair of pants convertible into a hammock. The pants, once converted into a hammock configuration, are adapted for suspension from an adjacent structure.

With increased population density and mobility comes a need for urban housing solutions. Just as the cost of houses and apartments increases, so too do the costs of temporary shelters and bed spaces. There is accordingly a need for creative solutions to relieve the urban housing shortage. The invention might also serve as a recreational luxury item that would relieve the need for a traveling person to bring along a portable dwelling as an accessory, by integrating the dwelling into the person's clothing.

Convertible garments are known for transforming into other useful configurations or for multiple uses. U.S. Pat. No. 6,014,772 to Connelly discloses a multi-purpose convertible garment with adjustable side vents that converts from a vest to a blanket or sleeping pad. U.S. Pat. No. 6,336,226 to Garcia discloses a convertible garment and method for converting pants into a satchel, backpack, gun case, or pillow. U.S. Pat. No. 5,864,888 to Archer discloses removable and convertible ski pants. U.S. Pat. No. 6,260,209 to St. Ange discloses a separable pants assembly designed for law enforcement personnel to accommodate a hand gun, radio, handcuffs, and other devices. U.S. Pat. No. 5,775,892 to Tisdale discloses trousers that convert to shorts and a long-sleeved shirt that converts to a short-sleeved shirt. However, nothing in the prior art teaches a garment that converts to a ground level or elevated sleeping platform.

SUMMARY OF THE INVENTION

Pants convertible into a hammock according to the invention comprise a pair of pant legs joined at a front side of each pant leg by a front fastener extending from the waist to crotch of the pair of pant legs, and joined at a back side of each pant leg by a companion back fastener extending from the waist to crotch of the pant legs. Each pant leg has an inseam fastener extending the full length of the inseam of the leg. The pant legs are convertible into a hammock configuration by (1) unfastening the front fastener to separate the front sides of the pant legs, (2) unfastening the back fastener to separate the back sides of the pant legs, (3) separating the pant legs, (4) unfastening the inseam fastener of each pant leg, (5) opening each pant leg into a flat formation, (6) abutting the bottom edges of the opened pant legs, and (7) fastening together the bottom edges of the pant legs with a bottom edge fastener. The pant legs thus converted to the hammock configuration may be suspended from an adjoining structure.

When the pant legs are joined together in the hammock configuration, the waist portions of each pant leg are at opposite longitudinal ends of the hammock configuration. At the waist portion of each pant leg is provided a hemmed band, open on both ends, forming a sleeve extending between the open ends. Each sleeve is appropriately dimensioned to receive one of a pair of rigid rods, each rod having a length at least as great as the width of the hammock configuration. When inserted in the sleeves in the waist portion of each pant leg—the end portions of the open pant legs in the hammock configuration—the rods rigidify the pant legs in the hammock configuration across its width.

Each of the rods is collapsible from a fully extended configuration to a collapsed configuration. The rods in collapsed configuration are approximately one-third their length in the fully extended configuration. Each pant leg has a pocket of sufficient depth to store one of the collapsed rods.

The pants in the hammock configuration are suspended from an adjacent surface using a plurality of straps attached to the inside surface of the pant legs. A first longitudinal strap extends between surface-anchoring ends of each of the two rods. The surface-anchoring ends of the rods serve to anchor the rods and pants to a selected point on an adjacent structure, preferably a vertical structure such as a hurricane fence. A second longitudinal strap extends between floating-side ends of the two rods, located opposite the surface-anchoring ends of the rods across the width of the pant legs in the hammock configuration. The first longitudinal strap is stitched to substantially the entire length of a surface-adjacent longitudinal edge of the pants in the hammock configuration, and the second longitudinal strap is stitched to substantially the entire length of a floating-side longitudinal edge of the pant legs in the hammock configuration. A pair of lateral straps extend from the floating-side ends of the rods to anchor points on the adjacent structure lateral to the surface-anchoring ends of the rods. Finally, a pair of suspension straps extend from the floating-side ends of the rods to superior anchor points on the adjacent structure above the surface-anchoring ends of the rods. Thus, by firmly securing the surface-anchoring ends of the rods in fixed positions on the adjacent structure, the suspension straps will suspend the floating-side ends of the rods from the adjacent structure, while the lateral straps provide side-to-side stability.

The straps attach to the rods by inserting the tip of each rod into a grommet on the end of each strap. Each rod expands to form an annular shoulder behind the tip. The tip of the rod is sized for insertion into the aperture of each grommet, but since the shoulder has a greater diameter than the aperture, the tip cannot be inserted past the shoulder. In this manner, once the pants have been arranged into the hammock configuration, the rods are inserted through the sleeves in the waist portions of the pant legs, the tips of the rods are inserted into the grommets of the first and second longitudinal straps, and the lateral and suspension straps are extended to the side and upwards, respectively, from the floating-side ends of the rods to lateral and superior anchor points on an adjacent vertical surface. A stable and comfortable elevated hammock is thus constructed in moments for suspension from a vertical surface.

A primary object of the invention is to provide a pair of wearable pants convertible into an elevated hammock.

Another object of the invention is to provide a pair of pants convertible into a hammock which has an integrally attached plurality of straps for suspending the pants in the hammock configuration from an adjacent structure.

A further object of the invention is to provide a pair of pants convertible into a hammock configuration, the pants in the hammock configuration having oppositely disposed sleeves sized for receiving a pair of rigid rods for rigidifying the pants across their width in the hammock configuration.

A still further object of the invention is to provide a pair of wearable pants that are cheap and easy to manufacture which can be readily converted into a viable elevated hammock suitable for accommodating an individual.

BRIEF DESCRIPTION OF THE ILLUSTRATIONS

Figure 5:
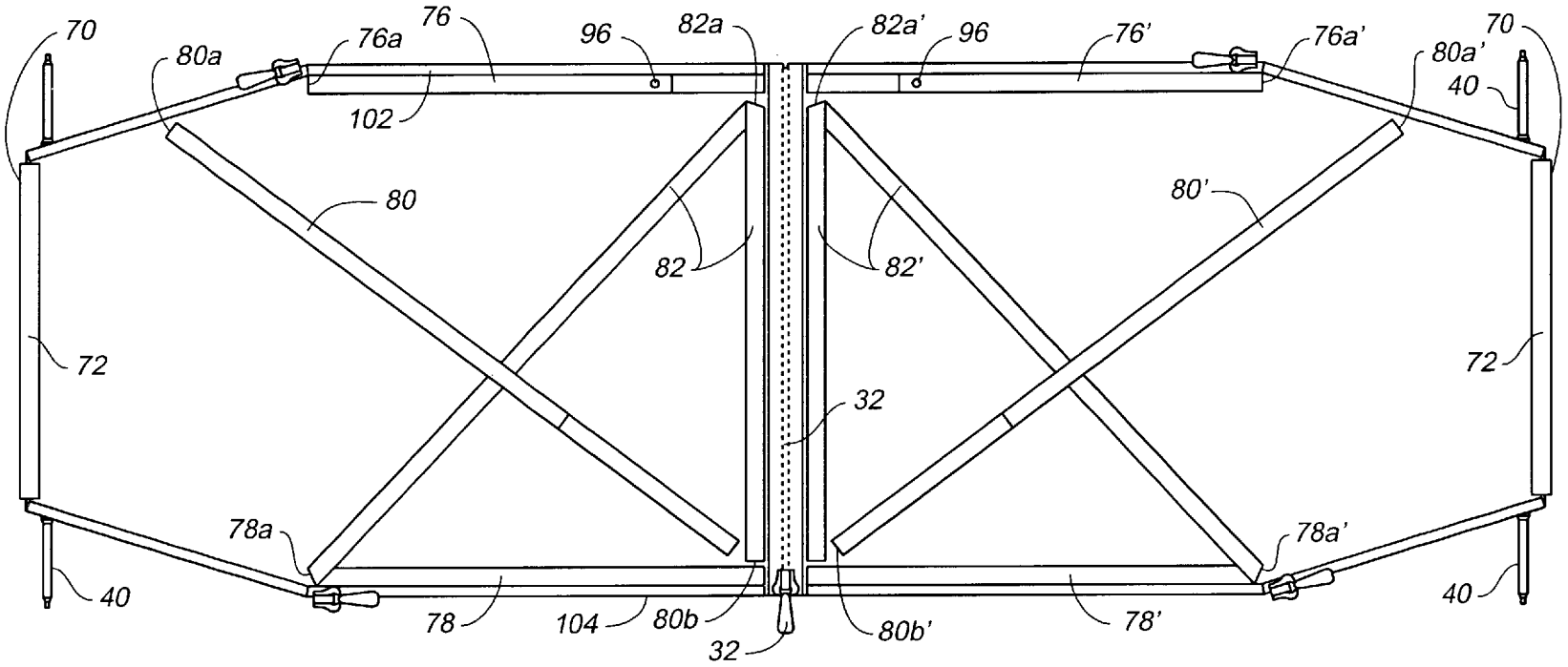
FIG. 5 is a plan view of the inside surface of the pants of FIG. 3 shown joined together at their bottom edges into a hammock configuration, with the rigid rods inserted in the waist portions of the pants.
Figure 7:
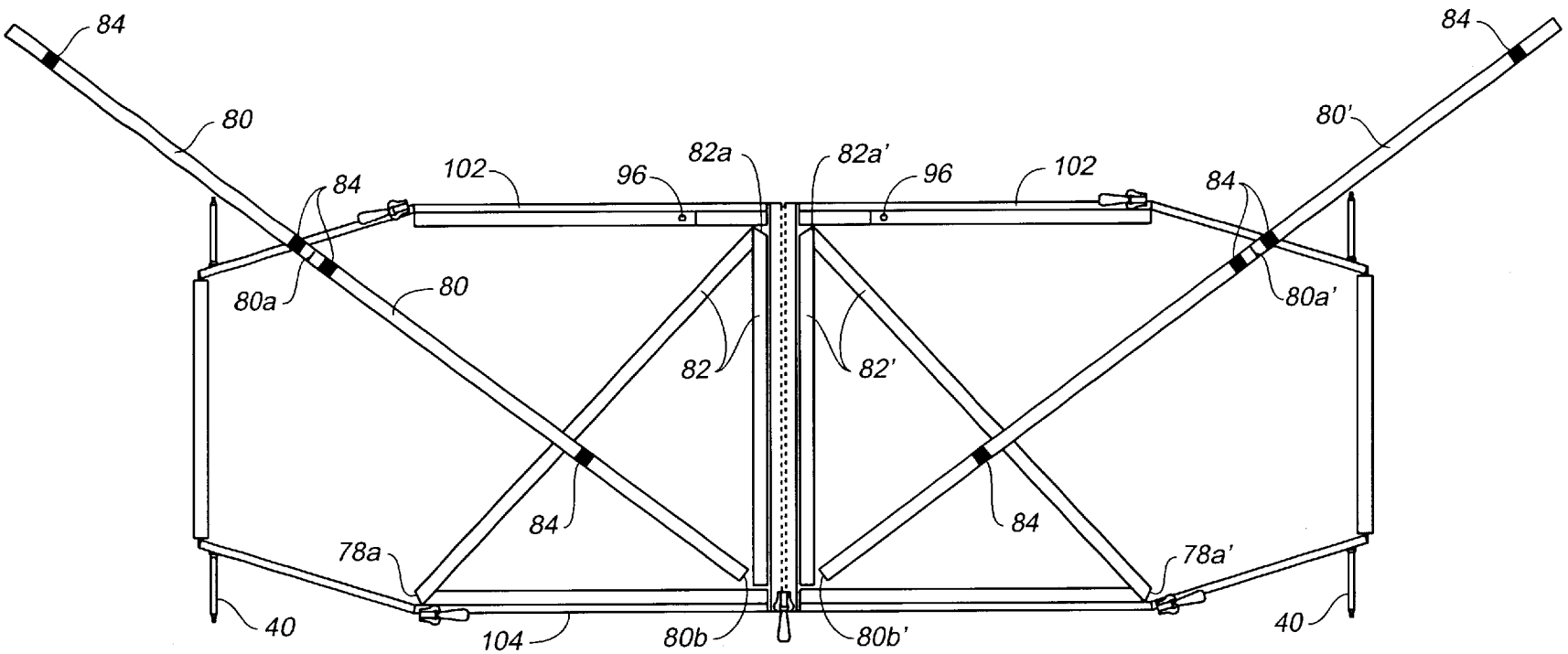
Figure 8:
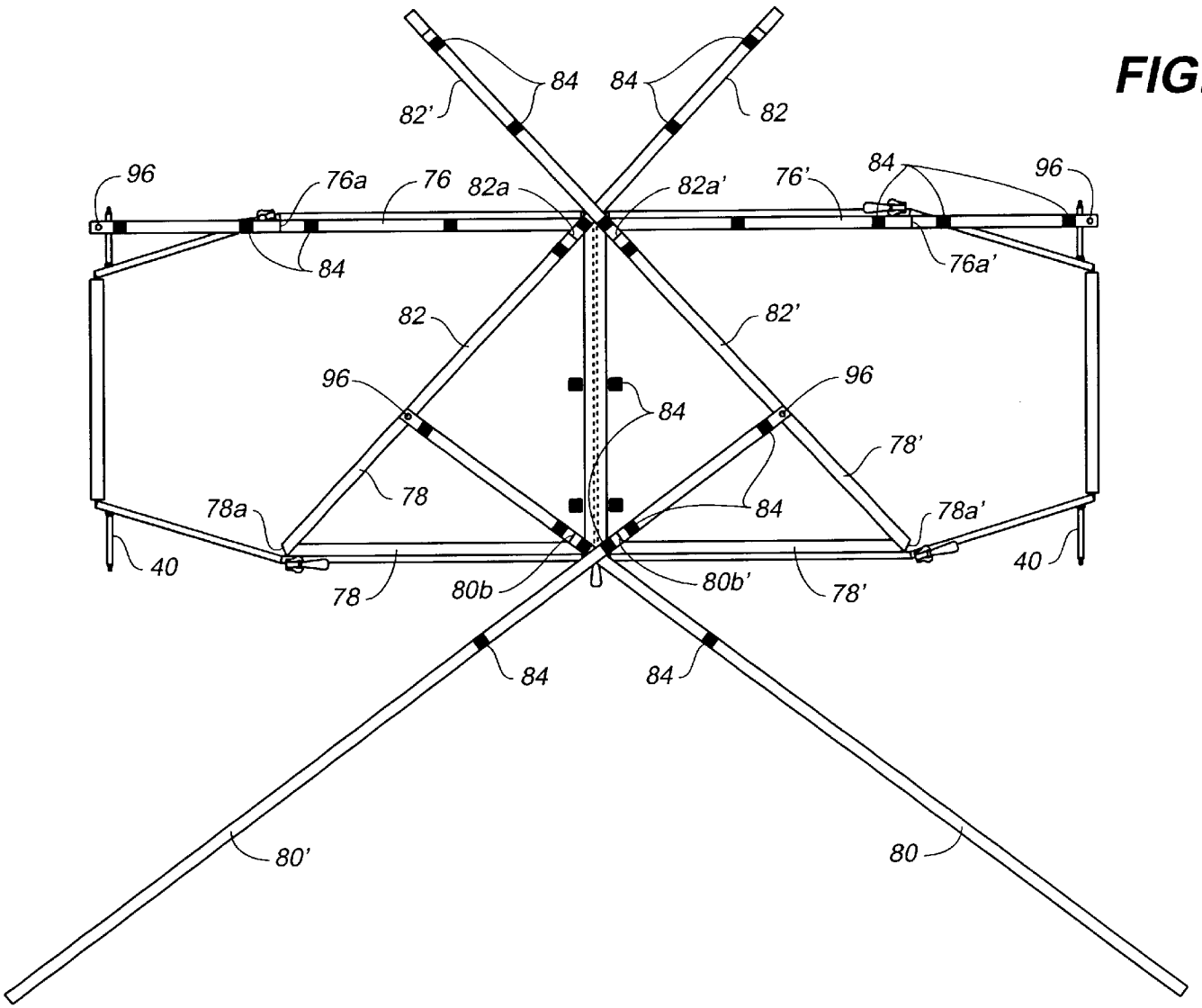
Figure 9:
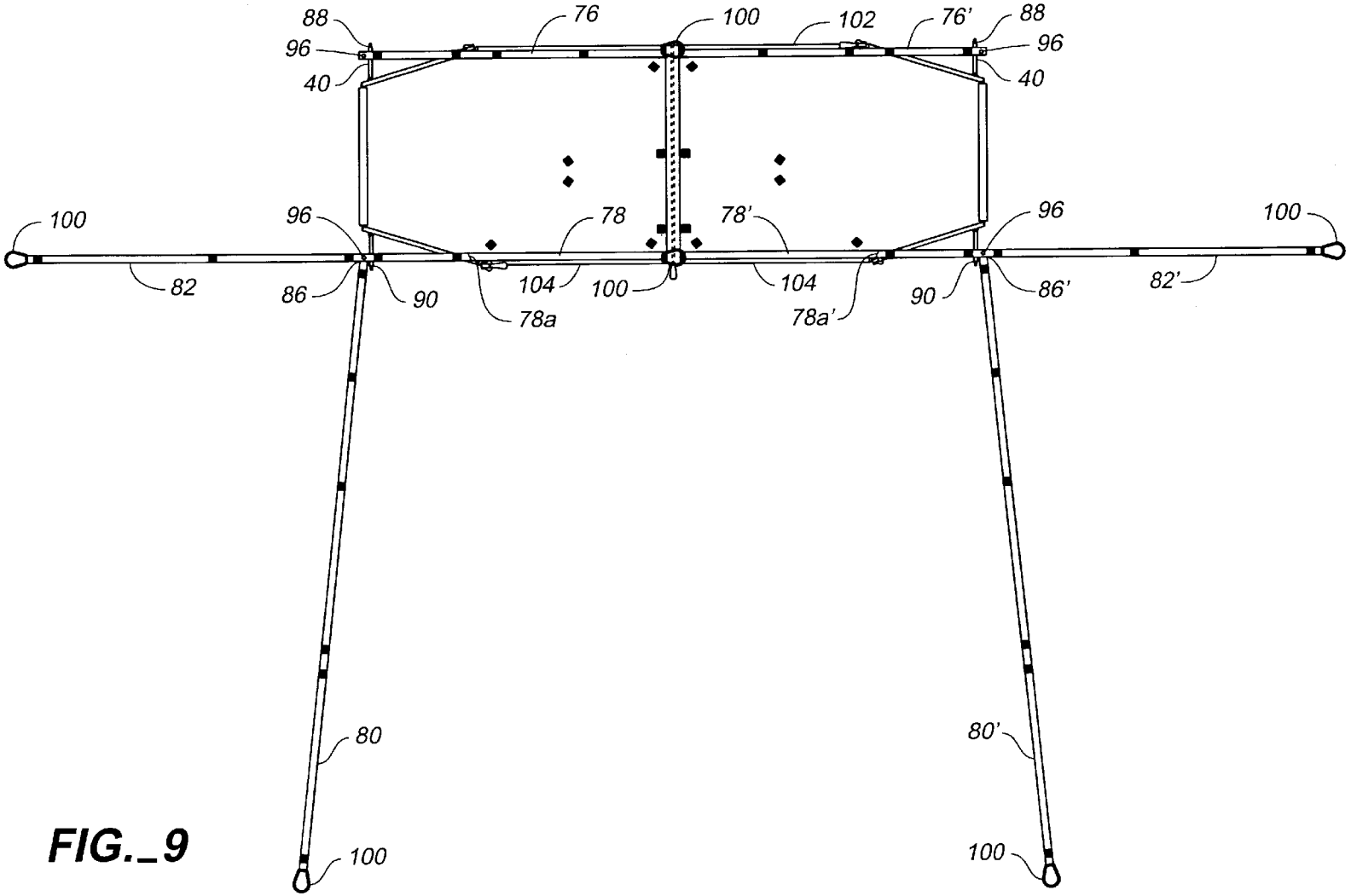

FIGS. 7, 8, and 9 are plan views of the pants of FIG. 5 showing the straps in various phases of being unfolded and extended.

Figure 10:
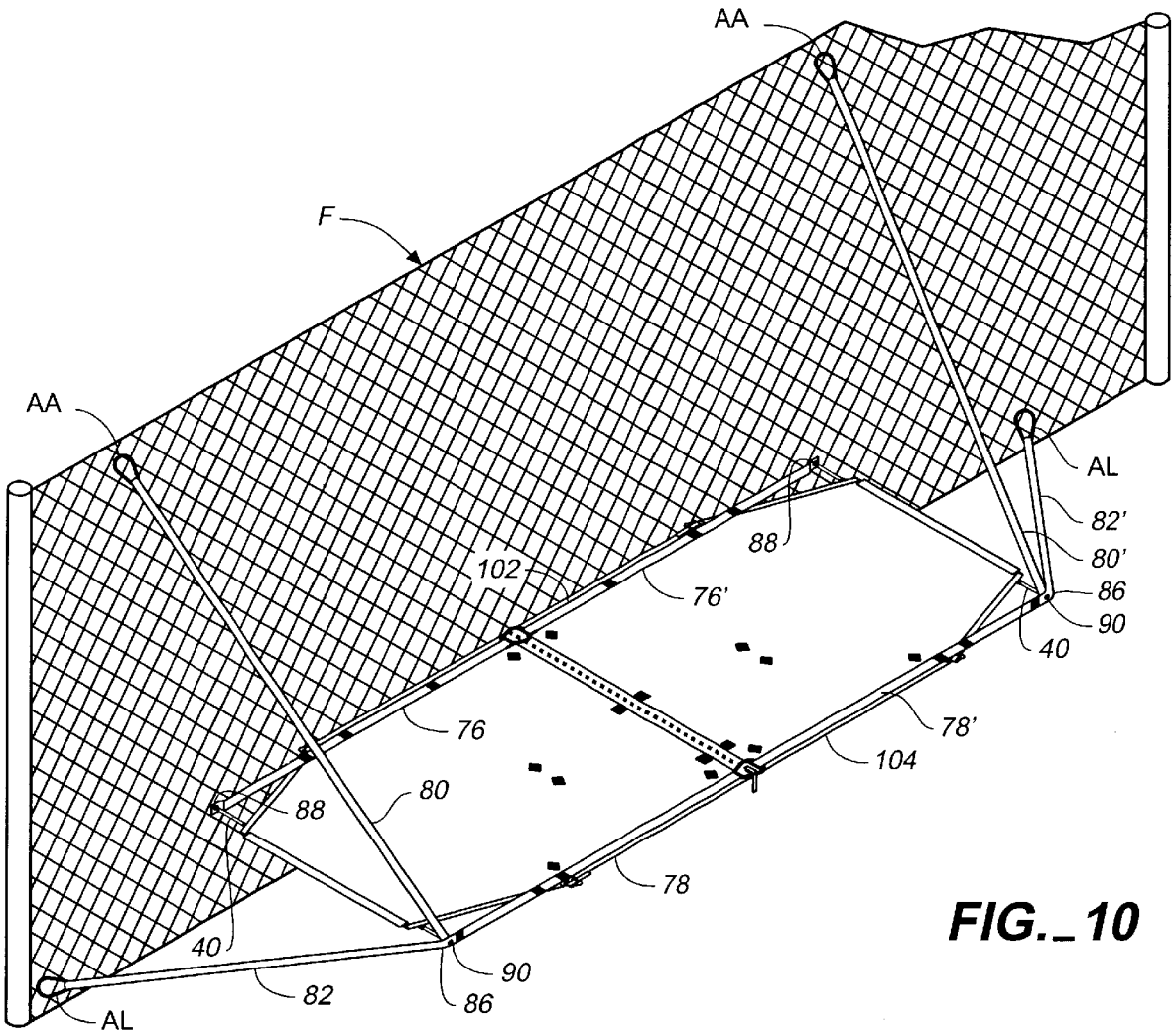

FIG. 10 is a perspective view of the pants of FIG. 5 attached to an adjacent vertical surface.

Figure 11:
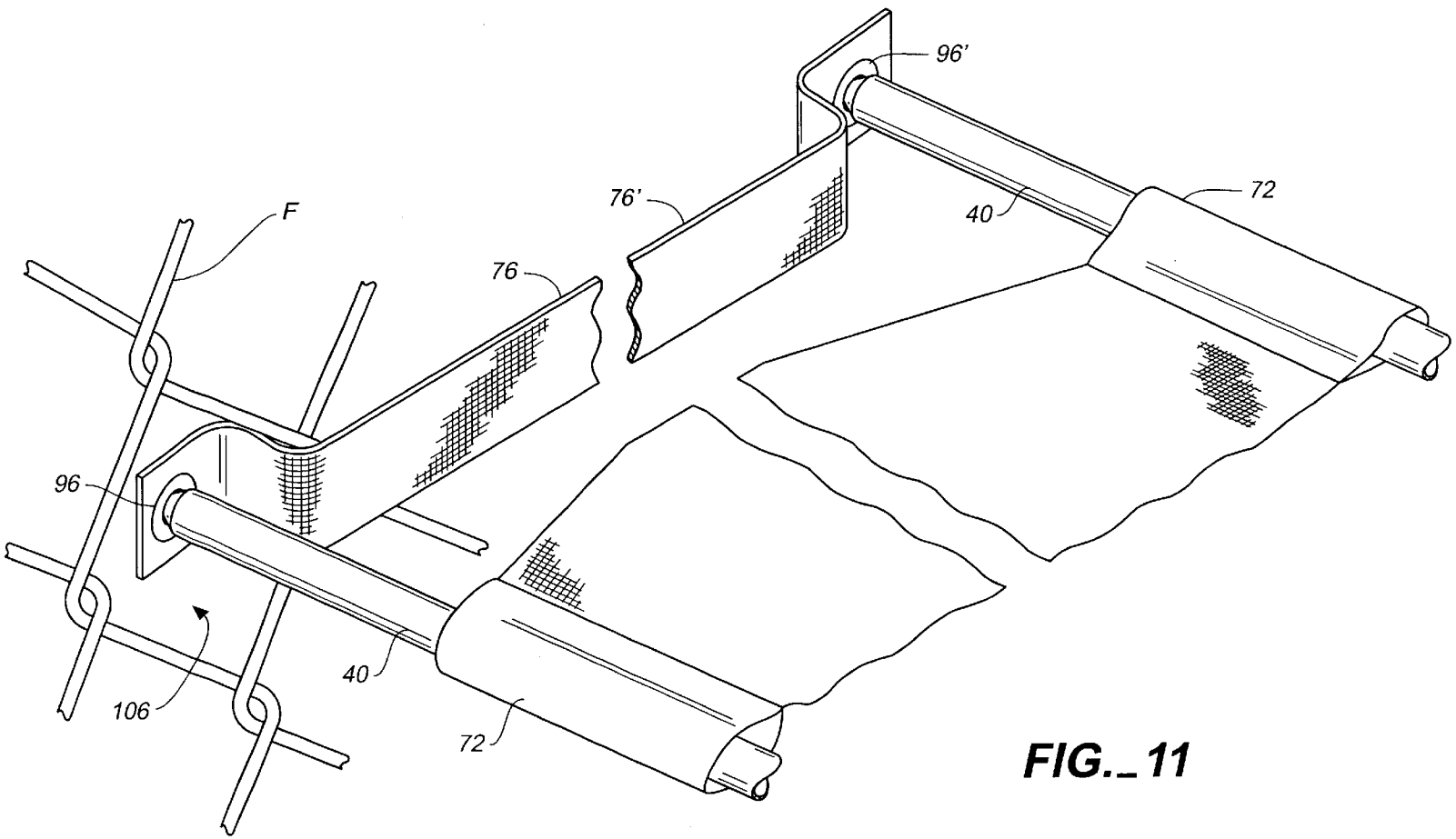

FIG. 11 is a fragmentary close-up perspective view of the surface-anchoring ends of the rigid rods and straps of the pants of FIG. 10 being inserted through openings in an adjoining fence.

Figure 11A:
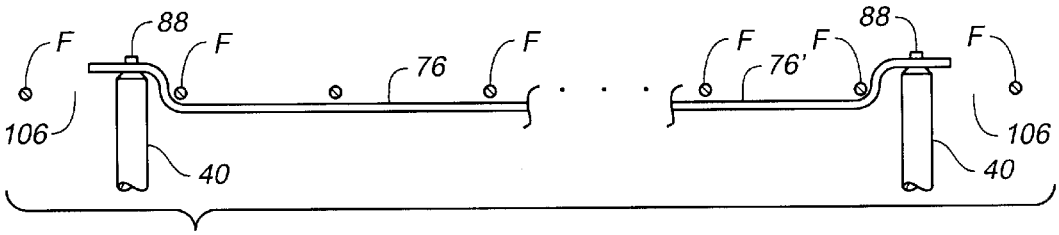

FIG. 11*a* is a fragmentary top plan view of the surface-anchoring ends of the rigid rods and straps of the pants of FIG. 11, the fence being shown in section.

Figure 1:
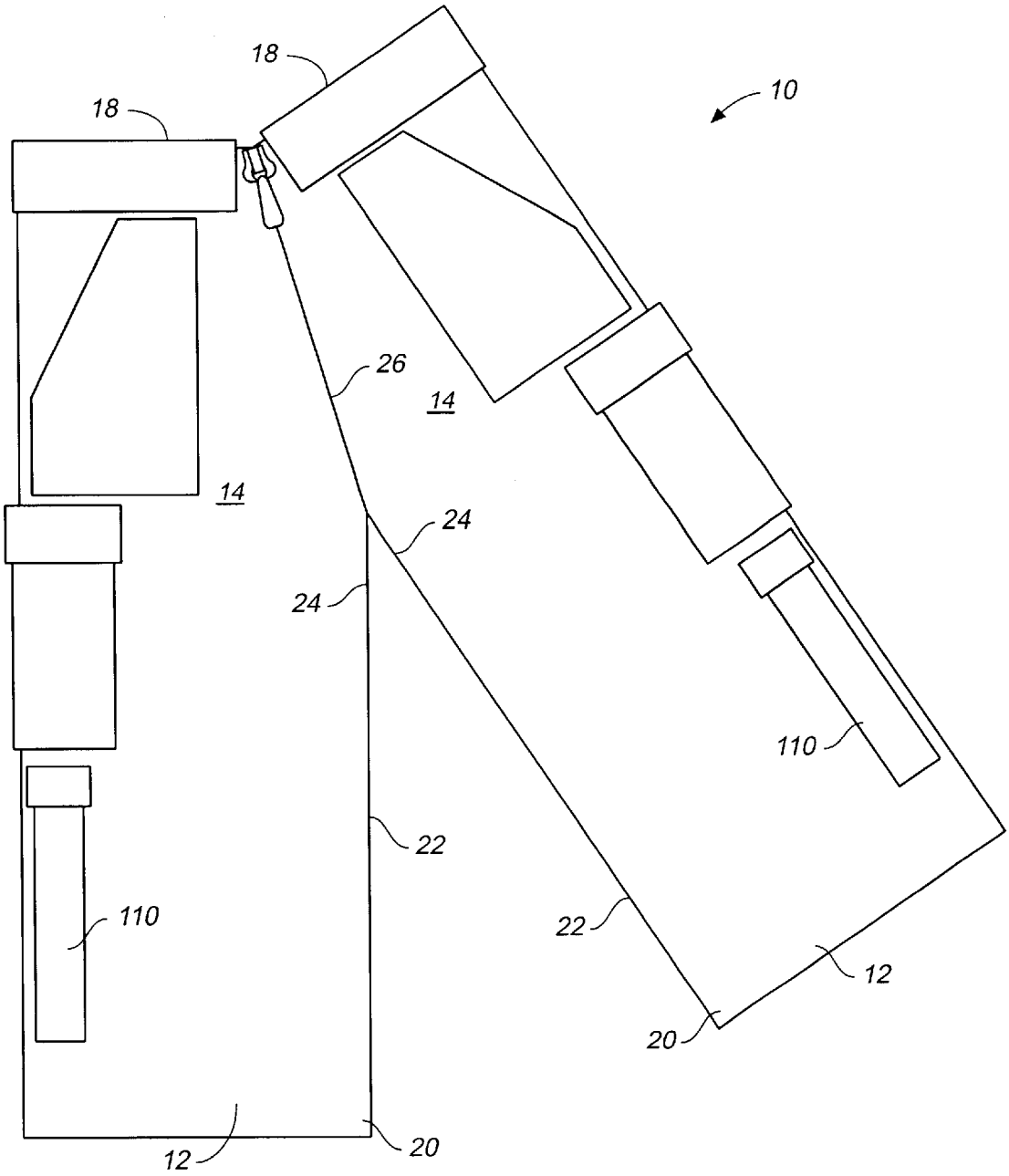
FIG. 1 is a plan view of the front side of a pair of pants convertible into a hammock according to the invention.
Figure 12:
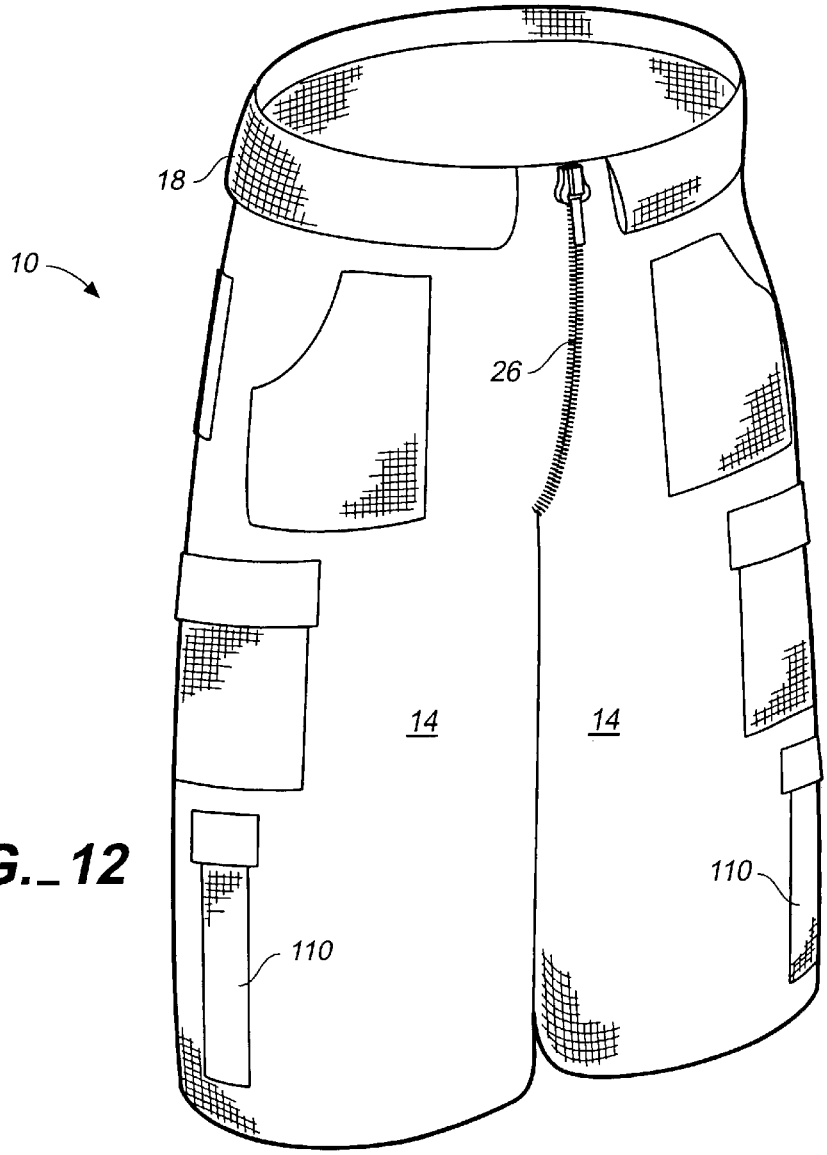

FIG. 12 is a perspective view of the pants of FIG. 1 according to the invention.

DETAILED DESCRIPTION OF THE ILLUSTRATED EMBODIMENT

Figure 1A:
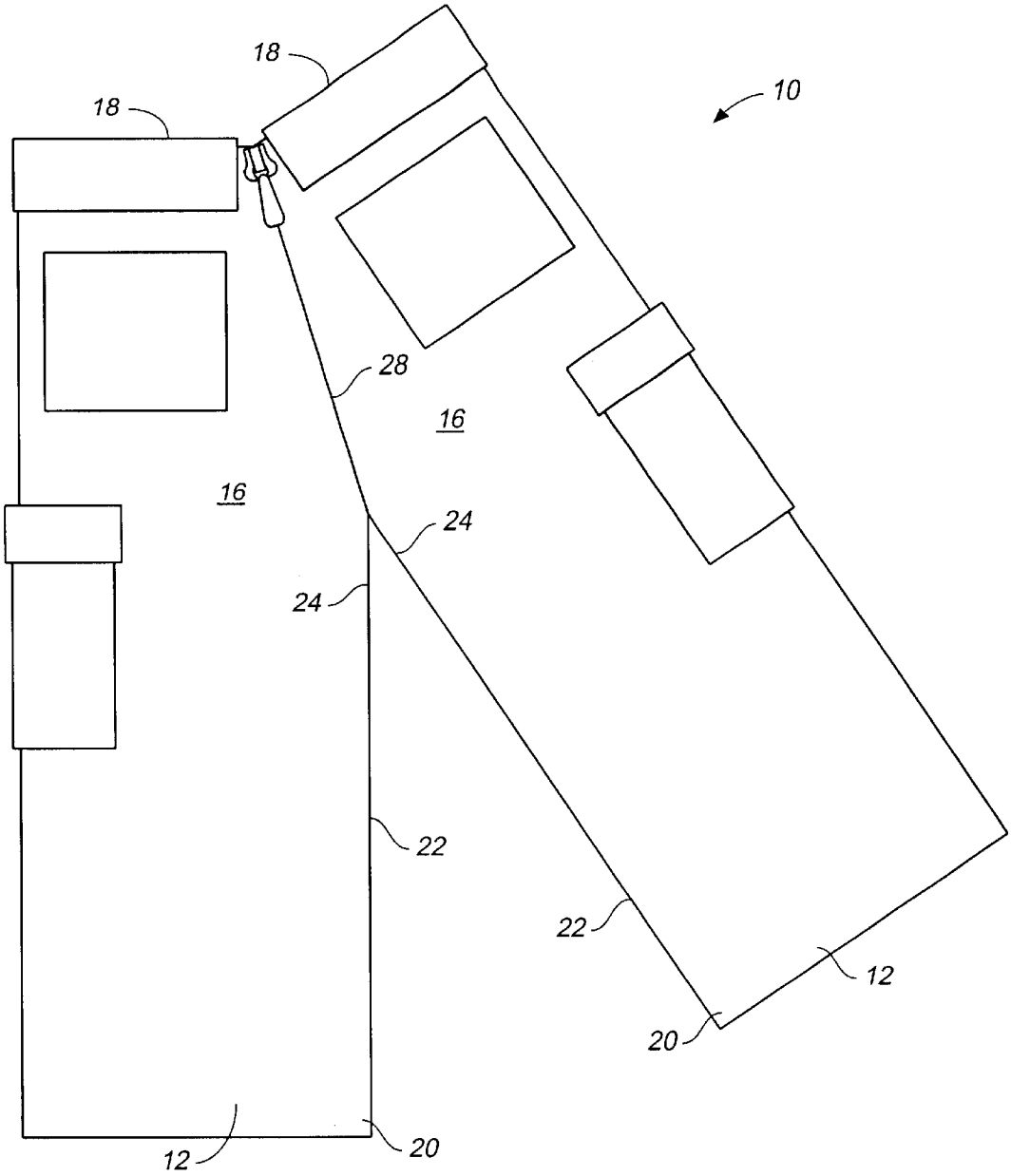
FIG. 1A is a plan view of the back side of the pants of FIG. 1.
Figure 2:
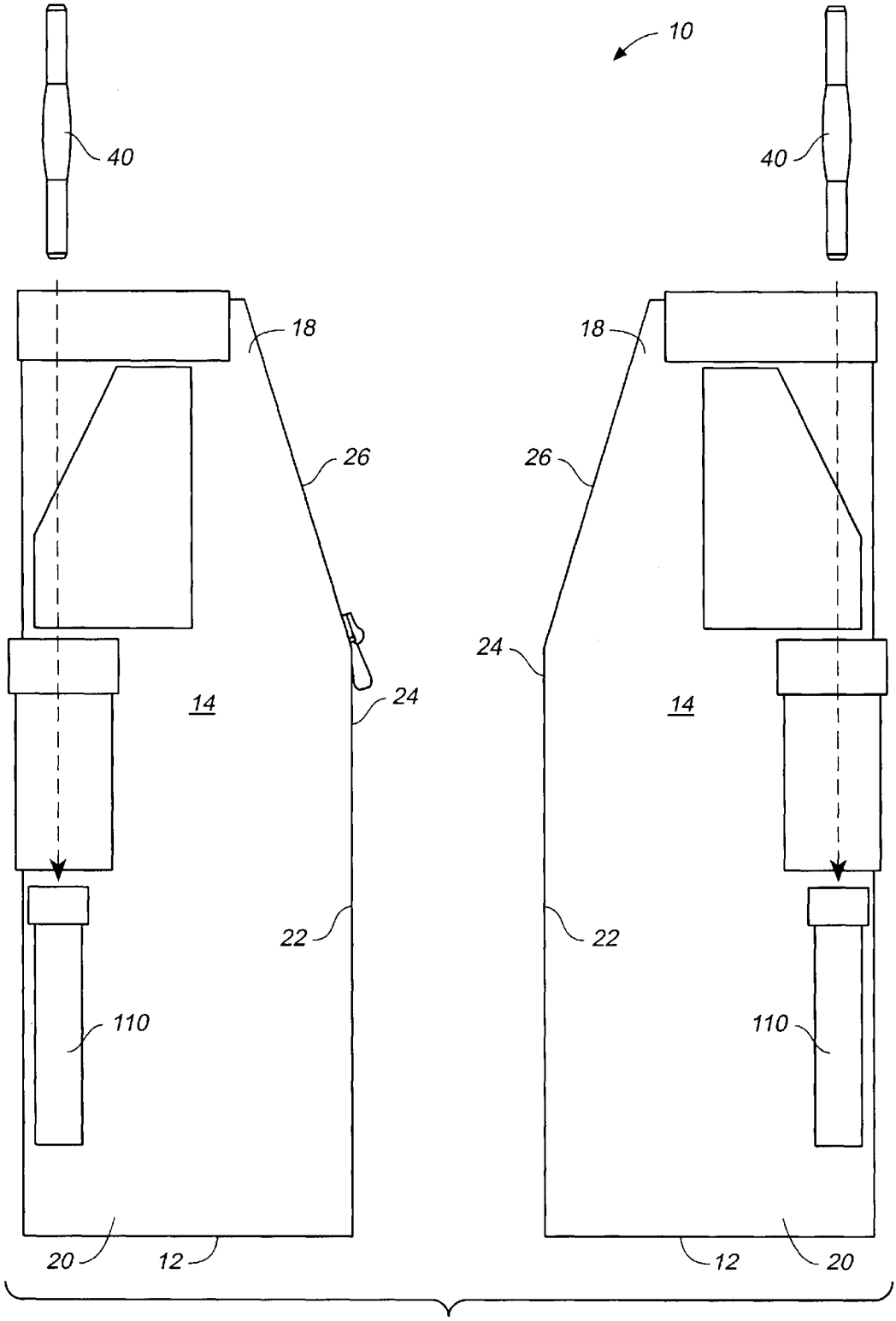
FIG. 2 is a plan view of the pants of FIG. 1 shown separated into two pant legs, and also showing a pair of rigid rods in collapsed configuration.

A pair of pants convertible into a hammock according to the invention is illustrated in the attached drawings and described as follows. Referring initially to FIGS. 1 and 1A, a pair of pants convertible into a hammock 10 comprises a pair of pant legs 12, each pant leg having a front side 14, a back side 16, a waist portion 18, a bottom edge 20, an inseam portion 22, and a crotch portion 24. A front fastener 26 extends from the waist portion 18 of the pant legs to the crotch 24, and joins together the front sides 14 of the pant legs. Similarly, a back fastener 28 extends from the waist portion 18 of the pant legs to the crotch 24 for joining together the back sides 16 of the pant legs. Accordingly, as seen in FIG. 2, the pant legs can be separated by unfastening the front fastener 26 and back fastener 28.

Figure 3:
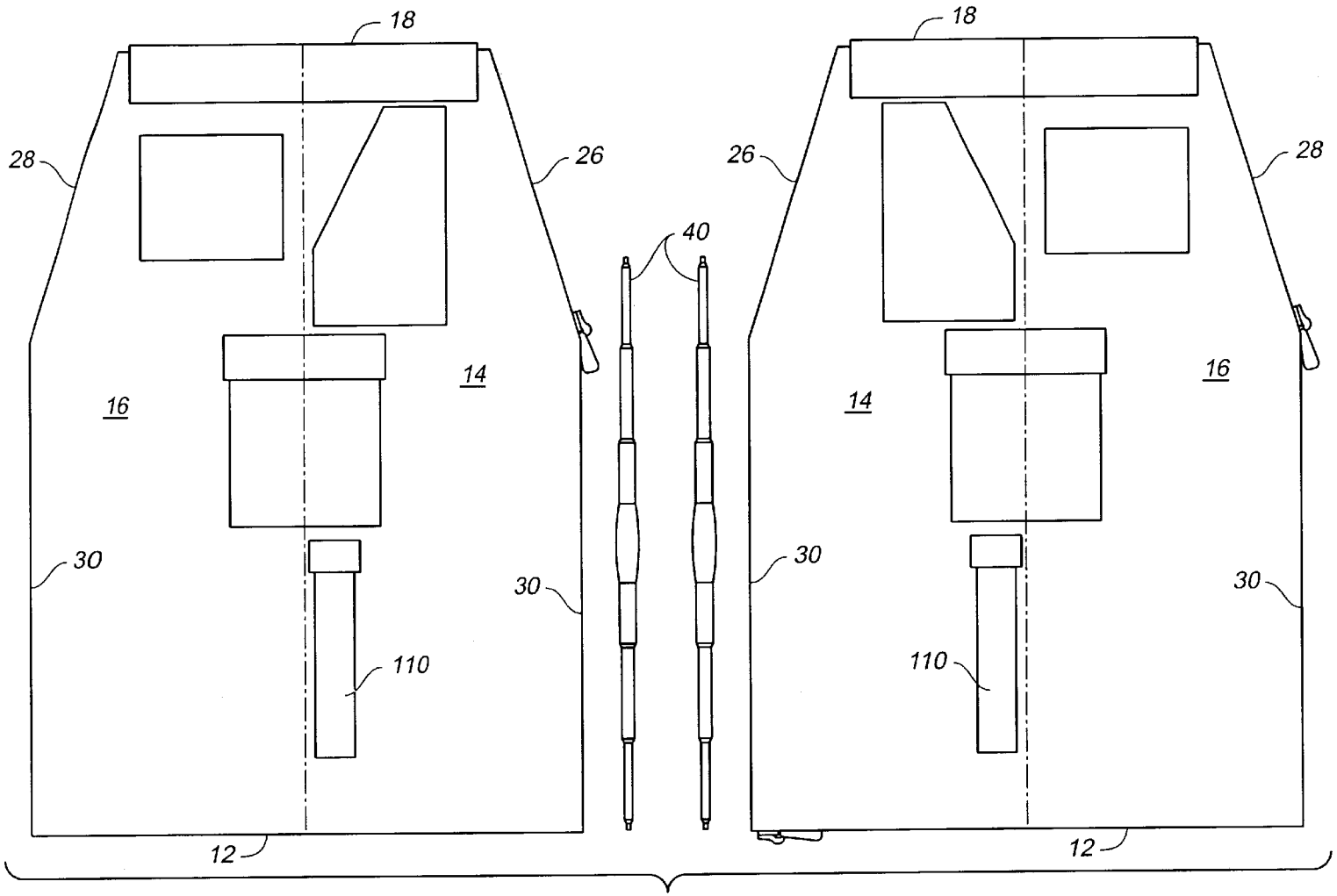
FIG. 3 is a plan view of the pant legs of FIG. 2, each opened into a flat formation, and also showing the pair of rods of FIG. 2 each opened into a fully extended configuration.

Referring now to FIG. 3, each pant leg 12 is shown having been opened into a flat formation by having unfastened an inseam fastener 30 at the inseam 22 of each pant leg. By laying the bottom edge 20 of each pant leg 12 in abutment to the other, the bottom edges may be joined together by a bottom edge fastener 32 into a hammock configuration as shown in FIG. 5.

In the preferred embodiment, the front fastener 26, back fastener 28, inseam fastener 30, and bottom edge fastener 32 are zippers. Bottom edge fastener 32 in the preferred embodiment is a heavy-duty fastener, given that it must support the weight of a person disposed on the hammock. However, in alternate embodiments, each or all of the fasteners comprise a plurality of loops and carabiners similar to the arrangement described in detail below, snaps, rivets, hook and catch arrangements, hook-and-loop type fasteners, or tied-off lengths of twine or rope.

Figure 4D:
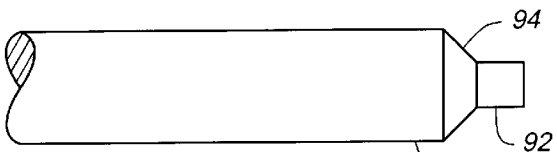
FIG. 4D is a close-up view of the preferred embodiment of the tip and shoulder of the end of one of the rigid rods.
Figure 4A:
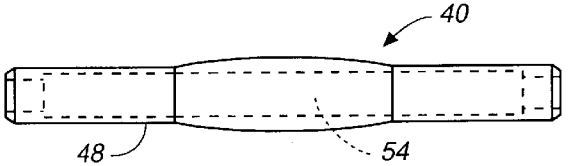
FIGS. 4A and 4B show one of the pair of rigid rods in a collapsed configuration and in a fully extended configuration.
Figure 4B:
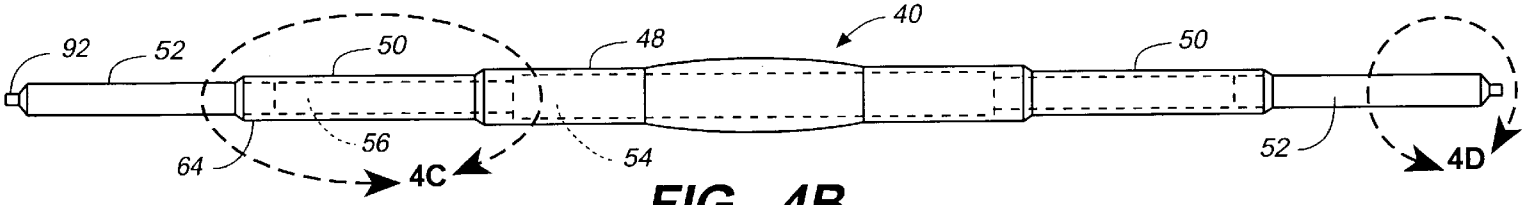

Referring now to FIGS. 4A and 4B, one of a pair of rigid rods 40 is illustrated in a collapsed configuration (FIG. 4A) and a fully extended configuration (FIG. 4B). Each rod comprises a main tube 48, a pair of extension tubes 50, and a pair of extension shafts 52. The main tube 48 has a center bore 54. Each of the extension tubes 50 may be slid into the center bore 54, the combined lengths of the extension tubes 50 being no greater than the length of the main tube 48. Similarly, each of the extension tubes 50 has an extension tube bore 56 of a diameter sufficient to receive one of the extension shafts 52. Thus the extension tubes and extension shafts may be collapsed inside the main tube 48. In FIG. 4B, extension tubes 50 have been extended out from the main tube 48, and the extension shafts 52 have been extended out from the extension tubes 50.

Figure 4C:
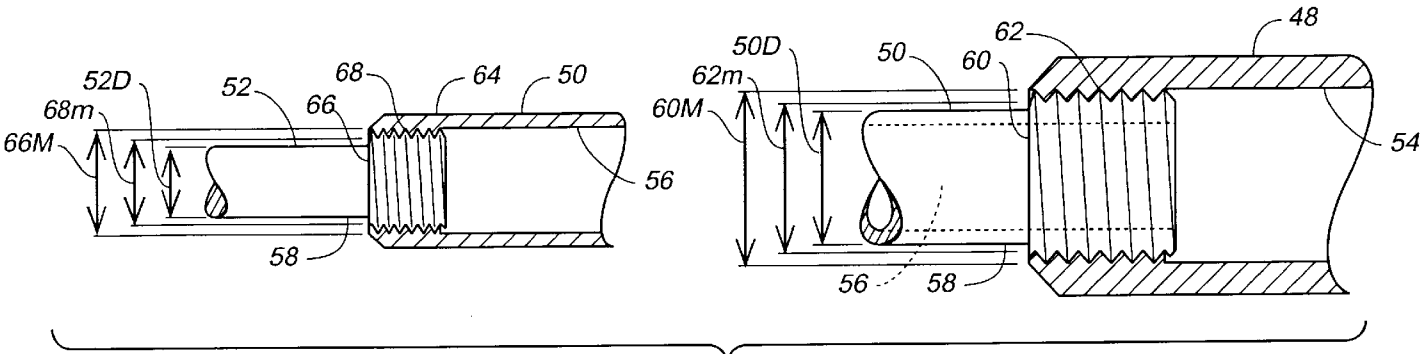
FIG. 4C is a blow-up of the threaded connection between the main tube and an extension tube of the rigid rod, and of the threaded connection between an extension tube and an extension shaft.

Referencing FIG. 4C, it is seen that extension tube 50 has a proximal end 58 and a proximal end thread set 60 for mating alignment with a main tube thread set 62. The diameter of the main tube's center bore 54 is greater than the major diameter 60M of the extension tube's proximal end thread set 60, such that when the proximal end thread set 60 is threaded all the way into and through the main tube thread set 62, the proximal end thread set 60 may slide into the main tube's center bore 54. Similarly, each extension tube 50 has an outer diameter 50D smaller than the minor diameter 62M of the main tube thread set 62, such that it may slide into the main tube thread set 62. In this manner, each extension tube 50 may be locked against lateral movement with respect to the main tube 48 by threading it into full engagement with the main tube thread set 62. However, when desired, the extension tubes 50 can be threaded and slid to their full length into the main tube 48.

The extension shafts 52 have a similar construction with respect to a distal end 64 of the extension tube 50. The extension shaft 52 has an extension shaft thread set 66 for mating engagement with an extension tube distal end thread set 68. The extension tube bore 56 has a diameter larger than the major diameter 66M of the extension shaft thread set 66, such that the extension shaft thread set 66, when threaded into and fully through the extension tube distal end thread set 68, slides into the extension tube bore 56. The extension shaft 52 has a diameter 52D smaller than the minor diameter 68M of the extension tube distal end thread set 68, allowing the extension shaft 52 to slide through the extension tube distal end thread set 68. The extension tube bore 56 has a length at least as great as the extension shaft 52. In this manner, the full extent of the extension shaft 52 may be inserted into the extension tube bore 56.

Figure 6:
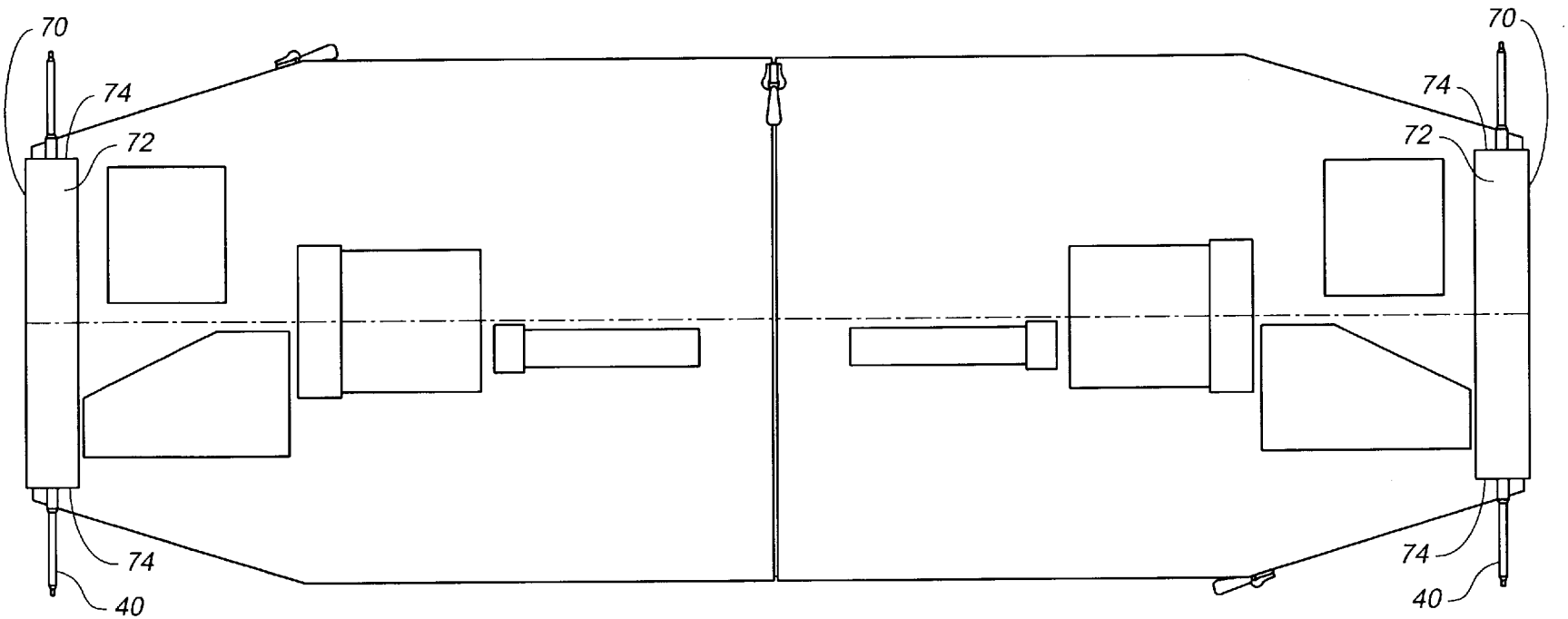
FIG. 6 is a plan view of the outside surface of the pants of FIG. 5.

Referring now to FIG. 6, each end 70 of the pants arranged in the hammock configuration is provided with a hemmed band 72 which forms a flexible sleeve, open at both ends 74, sized for insertion of one of the rods 40. Referring back to FIG. 5, a plurality of straps 76, 76', 78, 78', 80, 80', 82, and 82', are attached to the inside surface of pant legs 12. The straps are provided to adapt the unfolded pants for suspension from an adjacent structure. However, other components could be provided on the inside of the pants to adapt the pants, once unfolded, to a multitude of other uses such as a simple pad or a tent. In the illustrated embodiment, each of the straps is attached to the inside surface of the pants and is folded back and attached to itself using a plurality of hook-and-loop type fasteners 84 (FIG. 7). FIGS. 5, 7, 8, and 9 illustrate a progression of the straps 76, 76', 78, 78', 80, 80', 82, and 82' being unfolded. Straps 76 and 76' are unfolded at folds 76*a* and 76*a'* (FIG. 5) to their unfolded positions shown in FIGS. 8 and 9. Strap 78 is joined together with strap 80 and strap 82, as best seen at juncture point 86 in FIG. 9. Similarly, straps 80' and 82' are joined to strap 78' at juncture point 86'. In FIG. 5, it is seen that straps 80 and 80' are shown in their folded positions. Referring now to FIG. 7, it is seen that straps 80 and 80' have been unfolded at fold lines 80*a* and 80*a'*, respectively. In FIG. 8 it is seen that straps 80 and 80' have been unfolded again at fold lines 80*b* and 80*b'*. Referring back to FIG. 7, it is seen that straps 82 and 82' are shown in a folded position. In FIG. 8, it is seen that straps 82 and 82' have been unfolded at fold lines 82*a* and 82*a'*. With reference now to FIG. 9, it is seen that straps 78 and 78' have been unfolded at fold lines 78*a* and 78*a'*, unfolding not only straps 78 and 78' but reorienting straps 80, 80', 82, and 82' in a fully unfolded configuration.

With continuing reference to FIG. 9, straps 76 and 76' extend between surface-anchoring ends 88 of rigid rods 40. Similarly, straps 78 and 78' extend between floating-side ends 90 of rigid rods 40. FIG. 4D shows the preferred embodiment of the end portions of rods 40. Behind the rod tip 92 is a shoulder 94 having a larger diameter than the diameter of tip 92. Referring back to FIG. 9, once the straps are extended, they are attached to the rods by inserting rod tips 92 through grommets 96 in the straps. Each grommet 96 has an aperture large enough to admit tip 92, but smaller than shoulder 94, such that the rod tip 92 can be inserted into the aperture but not past shoulder 94. Each tip 92 extends from the shoulder 94 a sufficient length such that, when the tip 92 is inserted into the aperture, the rod 40 securely engages the grommet 96 and associated strap. Straps 76 and 76' are linked together using a carabiner 100 inserted through loops in adjoining portions of the straps. Similarly, straps 78 and 78' are linked together by insertion of a carabiner 100 through adjoining loops. Carabiners 100 are also provided on the ends of straps 80, 80', 82, and 82' for affixing the straps to an adjoining vertical structure, such as chain link fence F.

Referring now to FIG. 10, straps 80 and 80' extend from floating-side ends 90 of rods 40 and are attached to anchor points AA above surface-anchoring ends 88 of rods 40 to suspend the hammock pants from the vertical structure. Likewise, straps 82 and 82', which also extend from floating-side ends 90 of rods 40, are attached to anchor points AL lateral to the surface-anchoring ends 88 of rods 40 for restricting lateral movement of rods 40. Straps 76 and 76' are affixed to a surface-adjacent longitudinal edge 102 of the pant legs 12 in the hammock configuration. Straps 78 and 78' are likewise affixed to a floating-side longitudinal edge 104 of the pant legs 12. When straps 76, 76', and 78, 78' are stretched between the ends of rods 40, they help support the pant legs in hammock configuration between the rods.

If the hammock-configured pants are suspended from a chain link fence F, the downward force of gravity provided by weighting down the pants, e.g., by a person reclining in the hammock, will not only drive the hammock downward, but will drive the anchoring ends 88 of the rods 40 inwards through openings 106 in the fence F as shown in FIGS. 11 and 11A. Thus, lying on the hammock forces the anchoring ends 88 into the openings 106 in the fence F selected to serve as anchor points. Since the grommets 96 used to link straps 76, 76' to anchoring ends 88 are small enough to fit through the openings 106 in a chain link fence F along with the ends 88 of the rods, the grommets 96 will follow the rod ends 88 into the fence openings 106. This stretches linked straps 76, 76' between anchoring ends 88 until forces equalize at which point anchoring ends 88 are firmly embedded in the fence openings 106. It will be understood that the mechanics of securing the invention can be duplicated on any vertical surface where anchor points AA and AL and openings for anchor ends 88 can be found or replicated.

FIGS. 2 and 12 show that pockets 110 are provided on the front side of pant legs 12. Each pocket is longitudinally dimensioned to receive one of the rods 40 in its fully collapsed configuration.

There have thus been described certain preferred embodiments of pants convertible into a hammock. While preferred embodiments have been described and disclosed, it will be recognized by those with skill in the art that modifications are within the true spirit and scope of the invention. The appended claims are intended to cover all such modifications.

I claim:

1. Pants convertible into a hammock comprising:

a pair of pant legs, each leg having a front side, a back side, a waist portion, a bottom edge, an inseam portion, an inseam fastener at said inseam portion, and a crotch portion, a front fastener for joining said front sides of said legs together between said waist portion and said crotch portion, a back fastener for joining said back sides of said legs together between said waist portion and said crotch portion, a bottom edge fastener, and means for suspending said pant legs in a hammock configuration, in which said front fastener is unfastened, said front sides of said legs are separated, said back fastener is unfastened, said back sides of said legs are separated, said inseam fastener of each said pant leg is unfastened, each said pant leg is open in a flat formation, and said bottom edges of said pant legs in said flat formation are detachably joined together by said bottom edge fastener.

2. The pants of claim 1 wherein:

said pant legs in said hammock configuration have a width, and said means for suspending comprises a pair of rigid rods, each rod having a length at least as great as said width of said pant legs, said waist portion of each said pant leg having a hemmed band defining a sleeve, said sleeve having oppositely disposed open ends, and said sleeve sized through said open ends for removable insertion therein of one of said rods for rigidifying said pant legs in said hammock configuration across said width.

3. The pants of claim 2 wherein:

each said rod has a collapsed configuration and a fully extended configuration, said rod in said fully extended configuration having a length substantially equal to said width of said pant legs, and said rod is locale in said fully extended configuration.

4. The pants of claim 3 wherein:

each said rod further comprises a main tube, said main tube having two ends, a pair of extension tubes, each of said extension tubes having an extension tube distal end, and a pair of extension shafts, said main tube having a center bore for slidingly receiving therein said pair of extension tubes, each of said pair of extension tubes having an extension tube bore for slidingly receiving therein one of said pair of extension shafts, and locking means for fixing said pair of extension tubes to said ends of said main tube, and secondary locking means for fixing said extension shafts to said extension tube distal ends.

5. The pants of claim 3 wherein:

each said rod further comprises a main tube, said main tube having two ends and a center bore open at each said end, said center bore having a center bore diameter, each said end of said bore having a main tube thread set, said main tube thread set having a main tube thread set minor diameter, said rod further including a pair of extension tubes for extending from said ends of said main tube, each of said extension tubes having an extension tube outer diameter, an extension tube bore, said extension tube bore having an extension tube bore diameter, a proximal end, and a distal end, said extension tube bore open at said proximal and distal ends, said proximal end of said extension tube having a proximal end thread set, said proximal end thread set mating with said main tube thread set, said proximal end thread set having a proximal end thread set major diameter and a proximal end thread set minor diameter, said center bore diameter greater than said proximal end thread set major diameter, said main tube thread set minor diameter greater than said extension tube outer diameter, such that each of said extension tubes may be slidingly received in said center bore of said main tube, and such that threaded engagement of said main tube thread set with said proximal end thread set of said extension tube locks said extension tube against movement longitudinal to said main tube, said distal end of each of said extension tubes has an extension tube distal end thread set, said extension tube distal end thread set having an extension tube distal end thread set major diameter and an extension tube distal end thread set minor diameter, said rod further including a pair of extension shafts for extending from said distal ends of said extension tubes, each extension shaft having an extension shaft outer diameter and an extension shaft proximal end, said extension shaft proximal end having an extension shaft thread set for mating with said extension tube distal end thread set, said extension shaft thread set having an extension shaft thread set major diameter, said extension tube bore diameter greater than said extension shaft thread set major diameter, and said extension tube distal end minor diameter greater than said extension shaft outer diameter, such that each of said extension shafts may be slidingly received in one of said extension tube bores, and such that threaded engagement of said extension shaft thread set with said extension tube distal end thread set locks said extension shaft against movement longitudinal to said main tube, and each of said extension tube bores has a length at least as long as one of said extension shafts, and said center bore of said main tube has a length sufficient to receive entirely said pair of first extension tubes.

6. The pants of claim 2 further comprising:

each said rod having oppositely disposed ends, each said end having a tip and a shoulder, said shoulder having a diameter greater than said tip, said tip extending beyond said shoulder.

7. The pants of claim 2 further comprising:

each said rod having a surface-anchoring end for anchoring said rod to a selected point on an adjacent structure, and said rod having a floating-side end opposite said surface-anchoring end, and said means for suspending including a plurality of straps including a first longitudinal strap extendable between said surface-anchoring ends of said rods, a second longitudinal strap extendable between said floating-side ends of said rods, a pair of lateral straps each extendable from one of said floating-side ends of said rods for attachment to an anchor point lateral to said surface-anchoring ends of said rods on an adjacent structure, and a pair of suspension straps each extendable from one of said floating-side ends of said rods for attachment to an anchor point superior to said surface-anchoring ends of said rods on an adjacent structure for suspension of said floating-side ends from the adjacent structure.

8. The pants of claim 7 wherein:

each said end of each said rod has a tip and a shoulder, said shoulder having a diameter greater than said tip, said tip extending beyond said shoulder, and said first longitudinal strap and said second longitudinal strap each have oppositely disposed strap ends, each said strap end having a grommet, each of said grommets having an aperture sized to receive one of said tips of said rods, said diameter of said shoulder greater than said aperture.

9. The pants of claim 8 further including:

means for attaching said lateral straps and said suspension straps to anchor points on an adjacent structure.

10. The pants of claim 9 wherein:

said means for attaching comprises a plurality of carabiners, and each of said lateral straps and each of said suspension straps includes a free end having a loop for attachment of one of said carabiners.

11. The pants of claim 7 wherein:

said pant legs in said hammock configuration have a surface-adjacent longitudinal edge and a floating-side longitudinal edge disposed opposite said surface-adjacent longitudinal edge, said first longitudinal strap comprises a first length and a second length, and means for joining said first length and said second length, each of said lengths attached to one of said pant legs at said surface-adjacent longitudinal edge, and said second longitudinal strap comprises a first length and a second length, and means for joining said first length and said second length, each of said lengths attached to one of said pant legs at said floating-side longitudinal edge.

12. The pants of claim 11 wherein:

said means for joining said first and second lengths of said first longitudinal strap comprises said lengths having adjacent loops and a carabiner for connection of said loops, and said means for joining said first and second lengths of said second longitudinal strap comprises said lengths having adjacent loops and a carabiner for connection of said loops.

13. The pants of claim 7 wherein:

said pant legs each have an inside surface, and said pair of lateral straps and said pair of suspension straps are detachably affixed to said inside surfaces.

14. The pants of claim 13 further including:

a plurality of hook-and-loop type fasteners for detachably affixing said pair of lateral straps and said pair of suspension straps to said inside surfaces of said pant legs.

15. The pants of claim 1 wherein:

said front fastener comprises a zipper.

16. The pants of claim 1 wherein:

said back fastener comprises a zipper.

17. The pants of claim 1 wherein:

said inseam fastener comprises a zipper.

18. The pants of claim 1 wherein:

said bottom edge fastener comprises a zipper.

19. The pants of claim 3 further comprising:

each of said pant legs having a pocket having a depth sufficient to receive the entire length of one of said rods in said collapsed configuration.

20. The pants of claim 3 wherein:

each of said rods in said collapsed configuration is approximately one-third the length of said rods in said extended configuration.

21. Pants convertible into a hammock comprising:

a pair of pant legs, each pant leg having a front side, a back side, a waist portion, a bottom edge, an inseam portion, an inseam fastener at said inseam portion, and a crotch portion, said pair of pant legs having a front fastener for joining said front sides of said legs together between said waist portion and said crotch portion, and a back fastener for joining said back sides of said legs together between said waist portion and said crotch portion, said pair of pant legs having a hammock configuration in which said front fastener is unfastened for separation of said front sides of said pant legs, said back fastener is unfastened for separation of said back sides of said pant legs, said inseam fasteners of said pant legs are unfastened for opening said pant legs, said pant legs are opened to a flat formation, and said bottom edges of said pant legs in said flat formation are detachably joined together, said pant legs in said hammock configuration having a width, a pair of rigid rods, said waist portions of said pant legs each having a hemmed band defining a sleeve, said sleeve having oppositely disposed open ends, said sleeve sized through said open ends for removable insertion therein of one of said pair of rigid rods for rigidifying said pant legs in said hammock configuration across said width.

22. The pants of claim 21 wherein:

each of said pair of rigid rods has a fully extended configuration and a collapsed configuration, said rod locale in said fully extended configuration, said rod in said fully extended configuration having a length at least as long as said width of said pant legs, each of said pair of rigid rods having a surface-anchoring end for anchoring said rod to a selected position on an adjacent structure, and a floating-side end disposed opposite said surface-anchoring end, each of said ends of said rods having a tip and a shoulder, said shoulder having a diameter greater than said tip, said tip extending beyond said shoulder, a first longitudinal strap extendable between said surface-anchoring ends of said rods, and a second longitudinal strap extendable between said floating-side ends of said rods, said first and second longitudinal straps each having oppositely disposed strap ends, each said strap end having a grommet, each said grommet having an aperture sized to receive one of said tips of one of said rods, said diameter of said shoulder greater than said aperture, a pair of lateral straps each extendable from one of said floating-side ends of said rods for attachment to an anchor point on the adjacent structure lateral to said surface-anchoring ends of said rods, said lateral straps for retaining said pant legs in said hammock configuration against lateral movement respecting the adjacent surface, a pair of suspension straps each extendable from one of said floating-side ends of said rods for attachment to an anchor point on the adjacent structure superior to said surface-anchoring ends of said rods, said suspension straps for suspension of said pant legs in said hammock configuration from the adjacent structure, and means for attaching said lateral straps and said suspension straps to anchor points on the adjacent structure.

23. A method for converting a pair of pants into a hammock, the method comprising:

opening a front fastener extending from a waist portion to a crotch portion of a pair of joined pant legs, opening a back fastener extending from a waist portion to a crotch portion of a pair of joined pant legs, separating said pants legs, opening an inseam fastener at an inseam of each of said pant legs, opening each said pant leg to a flat formation, fastening together a bottom edge of each of said pant legs in said flat formation, and suspending said pant legs in said hammock configuration from an adjacent structure.

24. The method for converting a pair of pants into a hammock as recited in claim 23 wherein:

the step of suspending said pant legs includes inserting rigid rods having a length at least as great as a width of said pant legs in said hammock configuration in sleeves in said waist portions of said pant legs to rigidify said pant legs in said hammock configuration across said width.

* * * * *